US011261508B2

(12) United States Patent
Satoh

(10) Patent No.: US 11,261,508 B2
(45) **Date of Patent: *Mar. 1, 2022**

(54) MNAL ALLOY

(71) Applicant: TDK CORPORATION, Tokyo (JP)

(72) Inventor: Suguru Satoh, Tokyo (JP)

(73) Assignee: TDK CORPORATION, Tokyo (JP)

( * ) Notice: Subject to any disclaimer, the term of this patent is extended or adjusted under 35 U.S.C. 154(b) by 53 days.

This patent is subject to a terminal disclaimer.

(21) Appl. No.: 16/485,595

(22) PCT Filed: Mar. 9, 2018

(86) PCT No.: PCT/JP2018/009139

§ 371 (c)(1),
(2) Date: Aug. 13, 2019

(87) PCT Pub. No.: WO2018/173786

PCT Pub. Date: Sep. 27, 2018

(65) Prior Publication Data

US 2020/0002790 A1 Jan. 2, 2020

(30) Foreign Application Priority Data

Mar. 22, 2017 (JP) ..... JP2017-055459

(51) Int. Cl.
*C22C 22/00* (2006.01)
*C25C 3/36* (2006.01)
(Continued)

(52) U.S. Cl.
CPC ..... *C22C 22/00* (2013.01); *C22C 1/02* (2013.01); *C22F 1/18* (2013.01); *C25C 3/30* (2013.01); *C25C 3/36* (2013.01)

(58) Field of Classification Search
CPC ... C22C 22/00; C22C 1/02; C25C 3/36; C22F 1/18
See application file for complete search history.

(56) References Cited

U.S. PATENT DOCUMENTS

2020/0002797 A1* 1/2020 Satoh ..... C25D 3/66

FOREIGN PATENT DOCUMENTS

| | | | |
|---|---|---|---|
| JP | S36-11110 B | 9/1958 | |
| JP | 2014-228166 A | 12/2014 | |
| JP | 2017-045824 A | 3/2017 | |

OTHER PUBLICATIONS

The electrodeposition of A1-Mn ferromagnetic phase from molten salt electrolyte, G.R. Stafford, B. Grushko, and R.D. McMichael, Journal of Alloys and Compounds, 200 (1993) 107-113 (Year: 1993).*

(Continued)

*Primary Examiner* — Anthony J Zimmer
*Assistant Examiner* — Jacob J Gusewelle
(74) *Attorney, Agent, or Firm* — Young Law Firm, P.C.

(57) ABSTRACT

An object of the present invention is to provide a Mn-based alloy exhibiting metamagnetism over a wide temperature range. A MnAl alloy according to the present invention exhibits metamagnetism and has crystal grains containing a τ-MnAl phase and crystal grains containing a γ2-MnAl phase. Assuming that the area of the crystal grains containing the τ-MnAl phase in a predetermined cross section is B, and the area of the crystal grains containing the γ2-MnAl phase therein is A, the value of B/A is 0.2 or more and 21.0 or less. When the ratio of the areas between the crystal grains containing the τ-MnAl phase and those containing the γ2-MnAl phase is controlled within the above range, metamagnetism is imparted to the MnAl alloy and, thus, it is possible to obtain metamagnetism over a wide temperature range, particularly, over a temperature range of −100° C. to 200° C.

16 Claims, 8 Drawing Sheets

(51) Int. Cl.

| | |
|---|---|
| ***C22F 1/18*** | (2006.01) |
| ***C22C 1/02*** | (2006.01) |
| ***C25C 3/30*** | (2006.01) |

(56) References Cited

OTHER PUBLICATIONS

Microstructural and magnetic studies of Mn—Al thin films, P. C. Kuo, Y. D. Yao, J. H. Huang, S. C. Shen, and J. H. Jou, Journal of Applied Physics, 81 (1997) 5621-5623 (Year: 1997).*

Saturation magnetization and crystalline anisotropy calculations for MnAl permanent magnet, J. H. Park, Y. K. Hong, S. Bae, J. J. Lee, J. Jalli, G. S. Abo, N. Neveu, S. G. Kim, C. J. Choi, J. G. Lee, J. Appl. Phys. 107, 09A731 (2010); (Year: 2010).*

Microstructural examination and corrosion behavior of selective laser melted and conventionally manufactured Ti6Al4V for dental applications, Hafiz Muhammad Hamza; Kashif Mairaj Deen; Waseem Haider, 2020 (Year: 2020).*

The Quantification of Crystalline Phases in Materials: Applications of Rietveld Method, Claudia T. Kniess; Joao Cardoso de Lima; Patricia B. Prates, 2012 (Year: 2012).*

Estimation of the kinetics of martensitic transformation in austenitic stainless steels by conventional and novel approaches, M. Shirdel; H. Mirzadeh, M.H. Parsa, 2014 (Year: 2014).*

Park, J.H., et al., Saturation magnetization and crystalline anisotropy calculations for MnAl permanent magnet, Journal of Applied Physics 107,09A731 (2010).

* cited by examiner

| | Manufacturing Process of MnAl | Electrodeposition Temperature (℃) | Heat Treatment Temperature (℃) | Phase | Mn ratio in MnAl Arroy (Atom%) | Antiferro-magnetic Structure | Mn ratio in τ-MnAl Phase (Atom%) | Area Ratio (B/A) | Average Crystal Grain Diameter (μm) | Meta-magnetism | Saturation Magnetization (emu/g) | Residual Magnetization σr (emu/g) | Squareness Ratio σr/σmax | Residual Magnetization in room temperature |
|---|---|---|---|---|---|---|---|---|---|---|---|---|---|---|
| Comparative Example 1 | Electrodeposition Method | 300 | – | τ | 50 | Yes | 50 | ∞ | 0.06 | No | 79.4 | 17.5 | 0.22 | Yes |
| Comparative Example 2 | Electrodeposition Method | 250 | – | τ | 47.5 | Yes | 47.5 | ∞ | 0.05 | No | 69.2 | 11.1 | 0.16 | Yes |
| Comparative Example 3 | Electrodeposition Method | 200 | – | τ | 45 | Yes | 45 | ∞ | 0.03 | No | 51.2 | 4.6 | 0.09 | Yes |
| Example 1 | Electrodeposition Method | 300 | 400 | τ, γ2 | 50 | Yes | 51 | 21.0 | 0.30 | Yes | 95.0 | 23.8 | 0.25 | Yes |
| Example 2 | Electrodeposition Method | 300 | 425 | τ, γ2 | 50 | Yes | 51.5 | 4.9 | 0.24 | Yes | 102.2 | 16.4 | 0.16 | Yes |
| Example 3 | Electrodeposition Method | 300 | 450 | τ, γ2 | 50 | Yes | 52 | 4.0 | 0.62 | Yes | 116.1 | 12.8 | 0.11 | Yes |
| Example 4 | Electrodeposition Method | 300 | 475 | τ, γ2 | 50 | Yes | 52 | 3.7 | 0.91 | Yes | 118.2 | 2.4 | 0.02 | No |
| Example 5 | Electrodeposition Method | 300 | 500 | τ, γ2 | 50 | Yes | 52.5 | 3.3 | 0.47 | Yes | 115.7 | 1.2 | 0.01 | No |
| Example 6 | Electrodeposition Method | 300 | 550 | τ, γ2 | 50 | Yes | 53 | 3.3 | 0.83 | Yes | 103.1 | 1.0 | 0.01 | No |
| Example 7 | Electrodeposition Method | 300 | 562 | τ, γ2 | 50 | Yes | 53.5 | 1.0 | 0.51 | Yes | 89.5 | 4.5 | 0.05 | No |
| Example 8 | Electrodeposition Method | 250 | 550 | τ, γ2 | 47.5 | Yes | 49 | 0.5 | 0.73 | Yes | 47.9 | 3.8 | 0.08 | No |
| Example 9 | Electrodeposition Method | 200 | 550 | τ, γ2 | 45 | Yes | 48 | 0.2 | 0.66 | Yes | 25.5 | less than 0.1 | 0.0 | No |
| Comparative Example 4 | Electrodeposition Method | 300 | 600 | τ, γ2 | 50 | Yes | 55 | 0.1 | 1.09 | No | 9.2 | less than 0.1 | 0.0 | No |
| Comparative Example 5 | Electrodeposition Method | 300 | 650 | γ2, β | 50 | No | – | 0.0 | 1.13 | No | 1.2 | less than 0.1 | 0.0 | No |
| Comparative Example 6 | Electrodeposition Method | 300 | 700 | γ2, β | 50 | No | – | 0.0 | 1.21 | No | 0.5 | less than 0.1 | 0.0 | No |
| Comparative Example 7 | Melting Method | – | – | τ | 55 | No | 55 | ∞ | 1.67 | No | 108.0 | 43.2 | 0.40 | Yes |

FIG. 10

MNAL ALLOY

TECHNICAL FIELD

The present invention relates to a MnAl alloy and, more particularly, to a MnAl alloy having metamagnetism.

BACKGROUND ART

A MnAl alloy is conventionally known as a magnetic material. For example, the MnAl alloy disclosed in Patent Document 1 has a tetragonal structure and has a Mn/Al atomic ratio of 5:4 to thereby exhibit magnetism. Further, Patent Document 2 describes that by making a first phase composed of a MnAl alloy having a tetragonal structure and a second phase composed of $Al_8Mn_5$ crystal grains coexist, the MnAl alloy can be utilized as a permanent magnet having high coercive force.

Further, as disclosed in Patent Document 3, it is known that some of the magnetic materials having Mn as a main constituent element exhibit metamagnetism. The metamagnetism refers to a property in which magnetism undergoes transition from paramagnetism or antiferromagnetism to ferromagnetism by a magnetic field. A metamagnetic material exhibiting the metamagnetism is expected to be applied to a magnetic refrigerator, an actuator, and a current limiter.

CITATION LIST

Patent Document

[Patent Document 1] JP S36-11110 B
[Patent Document 2] JP 2017-45824 A
[Patent Document 3] JP 2014-228166 A

SUMMARY OF INVENTION

Technical Problem to be Solved by Invention

However, the metamagnetic materials described in Patent Document 3 all utilize first-order phase transition from paramagnetism to ferromagnetism by a magnetic field, so that they exhibit the metamagnetism only in the vicinity of the Curie temperature. Thus, practically, it is difficult to apply the metamagnetic materials to a current limiter and the like.

The present invention has been made in view of the above situation, and the object thereof is to provide a Mn-based alloy exhibiting the metamagnetism over a wide temperature range and a manufacturing method for such a Mn-based alloy.

Means for Solving the Problem

To solve the above problem and attain the object, the present inventor focused on a metamagnetic material (hereinafter, referred to as "AFM-FM transition type metamagnetic material") of a type undergoing transition from antiferromagnetism to ferromagnetism by a magnetic field. This is for the following reason: the AFM-FM transition type metamagnetic material exhibits metamagnetism at a temperature equal to or less than the Neel temperature where the antiferromagnetic order disappears, so that, unlike a metamagnetic material (hereinafter, referred to as "PM-FM transition type metamagnetic material") of a type undergoing transition from paramagnetism to ferromagnetism, it is not necessary to maintain a narrow temperature zone around the Curie temperature.

High crystal magnetic anisotropy and antiferromagnetism are required for realizing AFM-FM transition type metamagnetism. Thus, the present inventors focused on a Mn-based magnetic material using Mn exhibiting antiferromagnetism alone as the AFM-FM transition type metamagnetic material and examined various alloys/compounds. As a result, it was found that metamagnetism was exhibited over a wide temperature range by imparting an antiferromagnetic element to MnAl alloy which is a comparatively rare Mn-based alloy that exhibits ferromagnetism. The present invention has been made based on the above finding, and a MnAl alloy according to the present invention is characterized by having metamagnetism and having crystal grains containing a τ-MnAl phase and crystal gains containing a γ2-MnAl phase.

The present inventors have intensively studied further about the MnAl alloy and, as a result, they found that when crystal grains containing a τ-MnAl phase and crystal gains containing a γ2-MnAl phase coexisted at a predetermined ratio, metamagnetism was easily exhibited. That is, the crystal grains containing the τ-MnAl phase have ferromagnetism alone, and the crystal grains containing the γ2-MnAl phase has non-magnetism alone; however, when they are made to coexist at a predetermined ratio, antiferromagnetism is imparted to the τ-MnAl phase, whereby AFM-FM transition type metamagnetism is exhibited.

More specifically, in the MnAl alloy having the crystal grains containing the τ-MnAl phase and crystal grains containing the γ2-MnAl phase, assuming that the area of the crystal grains containing the τ-MnAl phase in a predetermined cross section of the MnAl alloy is B, and the area of the crystal grains containing the γ2-MnAl phase therein is A, the value of B/A is controlled to a range of 0.2 or more and 21.0 or less, whereby metamagnetism is imparted to the MnAl alloy, and thus it is possible to obtain metamagnetism over a wide temperature range, particularly, over a temperature range of −100° C. to 200° C.

The magnetic structure of the τ-MnAl phase in the MnAl alloy according to the present invention preferably has an antiferromagnetic structure. By using the Mn-based alloy whose antiferromagnetism is stable in a non-magnetic field state before phase transition, an AFM-FM transition type metamagnetic material is realized. When the stability of the antiferromagnetic state is too high, it is impossible to make phase transition to ferromagnetism by a magnetic field. On the other hand, when the stability of the antiferromagnetism is too low, phase transition to ferromagnetism may occur even with non-magnetic field or very weak magnetic field. In the MnAl alloy, an antiferromagnetic state is adequately stable, so that by imparting AFM-FM transition type metamagnetism, it is possible to obtain metamagnetism over a wide temperature range.

A mechanism of antiferromagnetism in the τ-MnAl phase by adjusting the amount of Mn on the Al site was examined by a first principle calculation, and it was found that the antiferromagnetism is caused by super exchange interaction between Mn atoms on the Mn site through p-orbital valence electrons in Al atoms in the Al site. The super exchange interaction is a kind of mechanism of exchange interaction in which 3d-orbital valence electrons of transition metal atoms work through orbital mixing with the p-orbital valence electrons in atoms having p-orbital valence electrons called ligand. When the angle among the transition metal atom, ligand, and transition metal atom experiencing coupling is close to 180°, antiferromagnetic coupling occurs. That is, in the τ-MnAl phase, the angle among Mn on the Mn site, Al on the Al site which is the ligand, and Mn in the directions (1, 1, 0) and (1, 1, 1) from the Mn site is close to 180°, and thus the antiferromagnetic coupling occurs. In addition, when Mn atoms are substituted on the Al site, the super exchange interaction does not occur between Mn atoms on the Mn site, and thus an antiferromagnetic structure is difficult to form. From the above findings, it was found that the stability of antiferromagnetism can be adjusted by adjusting the amount of Mn on the Al site in the τ-MnAl phase.

In the MnAl alloy according to the present invention, when the composition thereof is expressed by $Mn_bAl_{100-b}$, $45 \leq b < 55$ is preferably satisfied, and more preferably, $45 \leq b < 52$ is satisfied. By setting the composition ratio between Mn and Al in this range, metamagnetism can be imparted to the MnAl alloy. Further, in the MnAl alloy according to the present invention, when the composition of the τ-MnAl phase is expressed by $Mn_aAl_{100-a}$, $48 \leq a < 55$ is preferably satisfied.

In the present invention, the value of B/A may be 1.0 or more and less than 4.0. Thus, clear metamagnetism having little residual magnetization can be obtained and, at the same time, saturation magnetization can be enhanced.

In the present invention, the average crystal grain diameter of the crystal grains containing the τ-MnAl phase is 0.1 μm or more and 1.0 μm or less. Thus, the crystal grains containing the τ-MnAl phase and the crystal grains containing the γ2-MnAl phase are finely mixed together, making it easy to exhibit metamagnetism.

Advantageous Effects of the Invention

As described above, according to the present invention, there can be provided a MnAl alloy exhibiting metamagnetism over a wide temperature range.

BRIEF DESCRIPTION OF DRAWINGS

FIG. 10 is a table indicating evaluation results.

MODE FOR CARRYING OUT THE INVENTION

Figure 1:
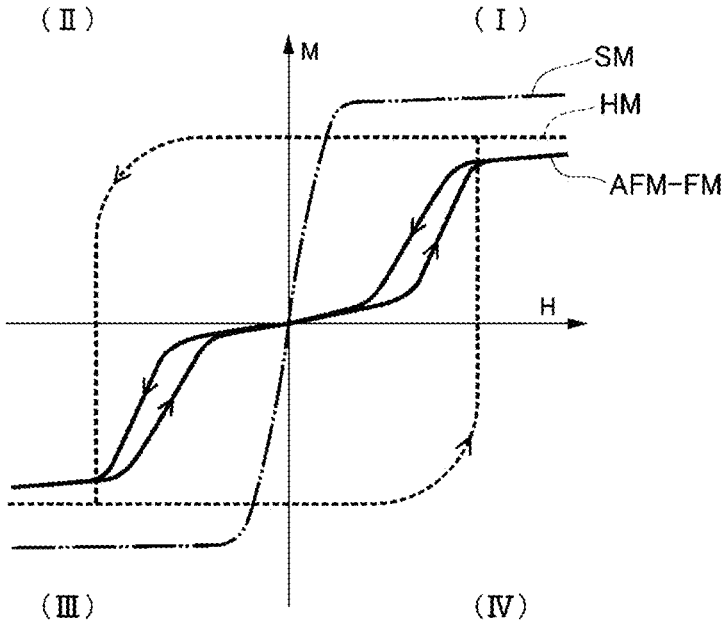
FIG. 1 is a graph illustrating the magnetic characteristics of the MnAl alloy exhibiting metamagnetism.

Hereinafter, preferred embodiments of the present invention will be described. The present invention is not limited to the embodiments and examples described below. Further, the constituent elements shown in the following embodiments and examples can be appropriately combined or selected for use.

The metamagnetism refers to a property in which magnetism undergoes first-order phase transition from paramagnetism (PM) or antiferromagnetism (AFM) to ferromagnetism (FM) by a magnetic field. The first-order phase transition by a magnetic field refers to the occurrence of discontinuity in a change in magnetization under a magnetic field. The metamagnetic material is classified into a PM-FM transition type metamagnetic material in which magnetism undergoes transition from paramagnetism to ferromagnetism by a magnetic field and an AFM-FM transition type metamagnetic material in which magnetism undergoes transition from antiferromagnetism to ferromagnetism by a magnetic field. In the PM-FM transition type metamagnetic material, the first-order phase transition occurs only in the vicinity of the Curie temperature; on the other hand, in the AFM-FM transition type metamagnetic material, the first-order phase transition occurs at a temperature equal to or less than the Neel temperature where the antiferromagnetism order disappears. The MnAl alloy according to the present embodiment is the AFM-FM transition type metamagnetic material, so that it exhibits metamagnetism over a wide temperature range.

The MnAl alloy according to the present invention has crystal grains containing a τ-MnAl phase and crystal grains containing a γ2-MnAl phase. The crystal grains containing the τ-MnAl phase alone have ferromagnetism, and the crystal grains containing the γ2-MnAl phase alone are non-ferromagnetic. Assuming that the area of the crystal grains containing the τ-MnAl phase in a predetermined cross section of the MnAl alloy is B, and the area of the crystal grains containing the γ2-MnAl phase therein is A, the value of B/A is controlled to a range of 0.2 or more and 21.0 or less, whereby AFM-FM transition type metamagnetism is achieved and, thus, metamagnetism can be obtained over a wide temperature range. The τ-MnAl phase is a crystal phase having a tetragonal structure and exhibits ferromagnetism by itself and, while when the ratio of the areas between the τ-MnAl phase and γ2-MnAl phase is set in the above range, antiferromagnetism is imparted to the τ-MnAl phase, whereby metamagnetism is exhibited.

The γ2-MnAl phase is also called $Al_8Mn_5$ phase, $Mn_{11}Al_{15}$ phase, r-MnAl phase, or γ-MnAl phase, and refers to a crystal phase having a rhombohedral crystal structure and in which lattice constants a and b are about 1.26 nm, a lattice constant c is about 0.79 nm, and the ratio of Mn to Al is about 31 at % to 47 at %.

Further, according to the present embodiment, the magnetic structure of the τ-MnAl phase contained in the MnAl alloy has an antiferromagnetic structure. The antiferromagnetic structure refers to a structure in which spin as the origin of magnetism of a magnetic material has a spatially periodic structure, and magnetization (spontaneous magnetization) as the entire magnetic material is absent, which differs from a paramagnetic structure in which the spin does not have a spatially periodic structure but has a disordered structure, and magnetization as the entire magnetic material is absent. By using the MnAl alloy whose antiferromagnetism becomes stable in a non-magnetic field state before the phase transition, the AFM-FM transition type metamagnetic material can be realized. When the stability of the antiferromagnetic state is too high, a magnetic field required for magnetic phase transition to ferromagnetism becomes too large, substantially disabling the occurrence of magnetic phase transition by a magnetic field. On the other hand, when the stability of the antiferromagnetic state is too low, magnetic phase transition to ferromagnetism may occur even in a non-magnetic field state or with a very weak magnetic field. By adjusting the stability of the antiferromagnetic state and imparting the AFM-FM transition type metamagnetism, the MnAl alloy can exhibit metamagnetism over a wide temperature range.

The crystal grains containing the τ-MnAl phase in the MnAl alloy according to the present embodiment is preferably composed of only by the τ-MnAl phase having the antiferromagnetic structure but may partially contain a ferromagnetic structure, a paramagnetic structure, or a ferrimagnetic structure. Further, while the antiferromagnetic structure of the τ-MnAl phase in the MnAl alloy may have a colinear type antiferromagnetic structure having a constant spin axis or a noncolinear type antiferromagnetic structure having a non-constant spin axis as long as it exhibits the metamagnetism, the antiferromagnetic structure having a long-period magnetic structure is more applicable since a magnetic field required for transition from antiferromagnetism to ferromagnetism is small.

In order for the τ-MnAl phase in the MnAl alloy according to the present embodiment to have the antiferromagnetic structure, the Al site in the τ-MnAl phase is preferably occupied by Al. In this case, the atom occupying the Al site may be any atom that has p-orbital valence electrons. Specifically, B, Ga, In, Tl, C, Si, Ge, Sn, Pb, N, P, As, Sb, Bi, O, S, Se, Te, Po, F, Cl, Br, I, and At having the p-orbital valence electrons may be candidates therefor.

The MnAl alloy according to the present embodiment contains the τ-MnAl phase, and when the composition formula of the τ-MnAl phase is expressed by $Mn_aAl_{100-a}$, $48 \leq a < 55$ is preferably satisfied. When a<48, the amount of Mn on the Al site becomes small, the stability of the antiferromagnetic state becomes very high, with the result that a magnetic field required for magnetic phase transition becomes large, which is disadvantageous for application. When a 55, Mn is contained more than Al, so that Mn is easily substituted on the Al site. The Mn substituted on the Al site is coupled antiferromagnetically to Mn on the Mn site, whereby Mn atoms on the Mn site are coupled ferromagnetically. As a result, ferrimagnetism occurs in the entire τ-MnAl phase, making it difficult to obtain metamagnetism. By setting the ratio of Mn in the T-MnAl phase so as to satisfy $48 \leq a < 55$ and by adjusting the stability of the antiferromagnetic state in a non-magnetic field state, it is possible to realize the AFM-FM transition type metamagnetism and thus to obtain meta magnetism over a wide temperature range.

The MnAl alloy according to the present embodiment is preferably composed of only the crystal grains containing the τ-MnAl phase and the crystal grains containing the γ2-MnAl phase; however, the MnAl alloy may contain different phases such as a β-MnAl phase and an amorphous phase as long as the value of B/A falls within the above range, and metamagnetism is exhibited. Further, as long as the value of B/A falls within the above range, and metamagnetism is exhibited, the MnAl alloy may be a multicomponent MnAl alloy in which a part of the Mn site or a part of the Al site is substituted with Fe, Co, Cr, or Ni.

Although there is no particular restriction on the composition ratio between Mn and Al in the MnAl alloy, it is preferable that Mn is 45 at % or more and less than 55 at % and Al is more than 45 at % and 55 at % or less, and is particularly preferable that Mn is 45 at % or more and 52 at % or less. That is, when the composition thereof is expressed by $Mn_bAl_{100-b}$, $45 \leq b < 55$ is preferably satisfied, and more preferably, $45 \leq b \leq 52$ is satisfied. By setting the composition ratio between Mn and Al in this range, the value of B/A mentioned above is easily controlled to a range of 0.2 or more and 21.0 or less.

There is no particular restriction on the value of B/A as long as it falls within a range of 0.2 or more and 21.0 or less; however, when the value is controlled to a range of 0.2 or more and less than 4.0, residual magnetization is eliminated, whereby clearer metamagnetism can be obtained. Particularly, when the value of B/A is controlled to a range of 1.0 or more and less than 4.0, large saturation magnetism can be obtained. As described later, the value of B/A can be controlled by the temperature of heat treatment to be applied to the MnAl alloy containing the τ-MnAl phase. To control the value of B/A by the heat treatment, the crystal grains preferably have somewhat small diameter, and the average crystal grain diameter of the crystal grains containing the τ-MnAl phase is preferably 0.1 μm or more and 1.0 μm or less.

FIG. 1 is a graph illustrating the magnetic characteristics of the MnAl alloy according to the present embodiment. In FIG. 1, the horizontal axis (X-axis) as a first axis indicates a magnetic field H, and the vertical axis (Y-axis) as a second axis indicates magnetization M. Further, in FIG. 1, "AFM-FM" indicates the magnetic characteristics of the MnAl alloy according to the present embodiment, "SM" indicates the magnetic characteristics of a typical soft magnetic material, and "HM" indicates the magnetic characteristics of a typical hard magnetic material.

As indicated by "SM" in FIG. 1, the typical soft magnetic material exhibits high permeability and is thus easily magnetized in the low magnetic field region, while when magnetic field strength exceeds a predetermined value, it is magnetically saturated and is hardly magnetized any further. In other words, in the magnetic field region where magnetic saturation does not occur, the differential value of the magnetization M with respect to the magnetic field H becomes large, while in the magnetic field region where magnetic saturation can occur, the differential value of the magnetization M with respect to the magnetic field H becomes small. Further, the typical soft magnetic material has no hysteresis or has very small hysteresis, so that the characteristic curve denoted by "SM" passes the origin of the graph or in the vicinity thereof. Therefore, the characteristic curve denoted by "SM" appears in the first quadrant (I) and third quadrant (III) of the graph and does not substantially appear in the second quadrant (II) and fourth quadrant (IV).

As indicated by "HM" in FIG. 1, the typical hard magnetic material has large hysteresis, and thus a magnetized state is maintained even with zero magnetic field. Therefore, the characteristic curve denoted by "HM" appears in all the first (I) to fourth (IV) quadrants.

On the other hand, as indicated by "AFM-FM" in the first and third quadrants (I) and (III) of the graph, the MnAl alloy according to the present embodiment exhibits the following characteristics: in the low magnetic region, it exhibits low permeability and is thus hardly magnetized; in the middle magnetic field region, it exhibits increased permeability and is easily magnetized; and in the high magnetic field region, it is magnetically saturated and is hardly magnetized any further. While slight hysteresis exists in the first and third quadrants (I) and (III) depending on electrodeposition conditions and heat treatment conditions described later, residual magnetization is zero or very small, so that the characteristic curve denoted by "AFM-FM" substantially passes the origin of the graph. Even when the characteristic curve denoted by "AFM-FM" does not pass exactly the origin of the graph, it passes in the vicinity of the origin with respect to the horizontal or vertical axis. This means that the same magnetic characteristics can be obtained irrespective of whether the MnAl alloy according to the present embodiment is in the initial state or in a state after it has repeatedly been applied with a magnetic field.

Figure 2:
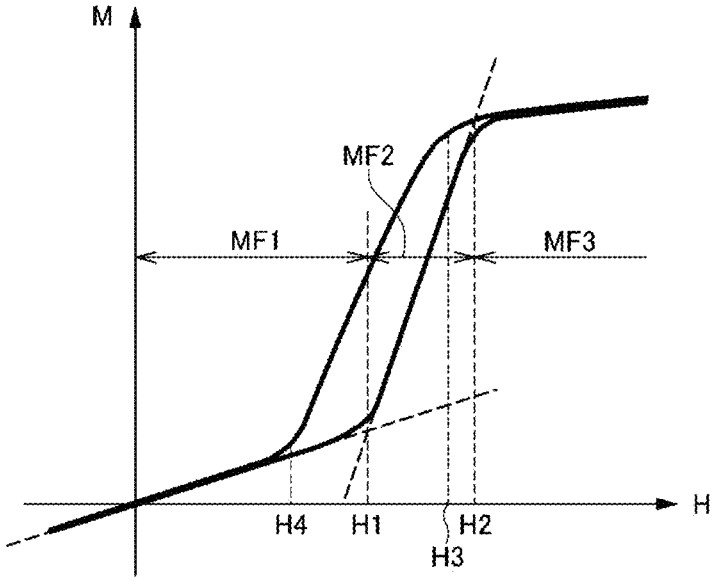
FIG. 2 is a graph illustrating the magnetic characteristics of the MnAl alloy exhibiting metamagnetism, where only the first quadrant (I) is illustrated.

FIG. 2 is a graph illustrating the magnetic characteristics of the MnAl alloy according to the present embodiment. In this graph, only the first quadrant (I) is illustrated.

The magnetic characteristics of the MnAl alloy according to the present embodiment will be described more specifically by way of FIG. 2. When the magnetic field is increased from a state where the magnetic field H is absent, the permeability is low in the region (first magnetic field region MF1) up to a first magnetic field strength H1, and thus increase in the magnetization M is small. The inclination of the graph, i.e., the differential value of the magnetization M with respect to the magnetic field H changes with the permeability. The permeability in the first magnetic field region MF1 is almost the same with the permeability of a non-magnetic material, so that the MnAl alloy according to the present embodiment behaves substantially as a non-magnetic material in the first magnetic field region MF1.

On the other hand, the permeability rapidly increases in the region (second magnetic field region MF2) from the first magnetic field strength H1 to a second magnetic field strength H2, and thus the value of the magnetization M significantly increases. That is, when the magnetic field is increased, the permeability rapidly increases with the first magnetic field strength H1 as a boundary. The permeability in the second magnetic field region MF2 is close to the permeability of a soft magnetic material, so that the MnAl alloy according to the present embodiment behaves as a soft magnetic material in the second magnetic field region MF2.

When the magnetic field is further increased to exceed the second magnetic field strength H2 (to reach a third magnetic field region MF3), magnetic saturation occurs, so that the inclination of the graph, i.e., the permeability reduces again.

Conversely, when the magnetic field is reduced from the third magnetic field region MF3 to fall below a third magnetic field strength H3, the permeability increases again in the region up to a fourth magnetic field region MF4. Then, the permeability reduces when the magnetic field falls below the fourth magnetic field strength H4, and the MnAl alloy according to the present embodiment behaves as a non-magnetic material again. As described above, the MnAl alloy according to the present embodiment has hysteresis in the first quadrant (I), but residual magnetization hardly exists, so that the same characteristics as those described above can be obtained when the magnetic field H is once set back to around zero.

Although the vertical axis indicates the magnetization M in the graphs illustrated in FIGS. 1 and 2, it may indicate a magnetic flux density B. Such substitution still can satisfy the relationship same with the former instance.

Figure 3:
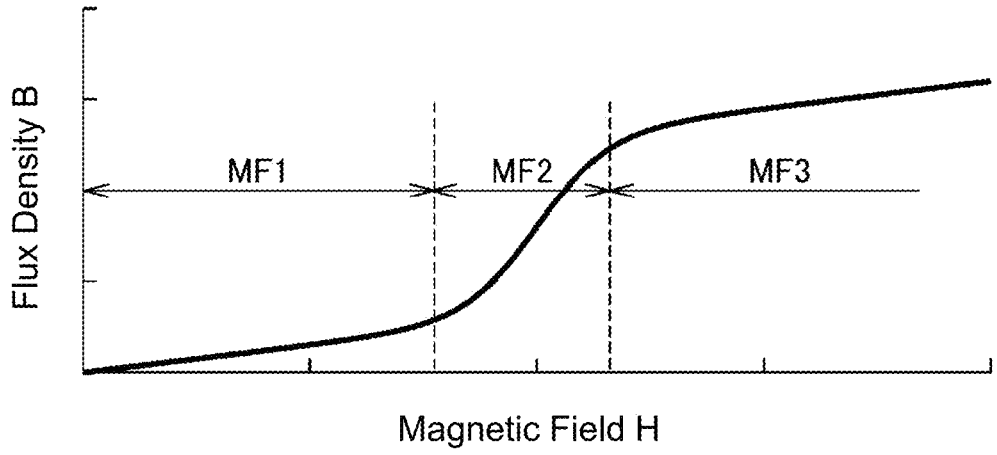
FIG. 3 is another graph illustrating the magnetic characteristics of the MnAl alloy exhibiting metamagnetism.

FIG. 3 is another graph illustrating the magnetic characteristics of the MnAl alloy according to the present embodiment. In this graph, the horizontal axis as a first axis indicates the magnetic field H, and the vertical axis as a second axis indicates the magnetic flux density B.

As illustrated in FIG. 3, even when the vertical axis indicates the magnetic flux density B, the magnetic characteristics of the MnAl alloy according to the present embodiment exhibits the same characteristic curve in the first quadrant (I) of the graph. That is, the inclination is small in the first magnetic field region MF1 with a low magnetic field, it rapidly becomes large in the second magnetic field region MF2 with a middle magnetic field, and it becomes small again in the third magnetic field region MF3 with a high magnetic field. Further, in the graph shown in FIG. 3, the characteristic curve representing the magnetic characteristics of the MnAl alloy according to the present embodiment passes substantially the origin of the graph and, even when the characteristic curve does not pass exactly the origin of the graph, it passes in the vicinity of the origin with respect to the horizontal or vertical axis.

Figure 4:
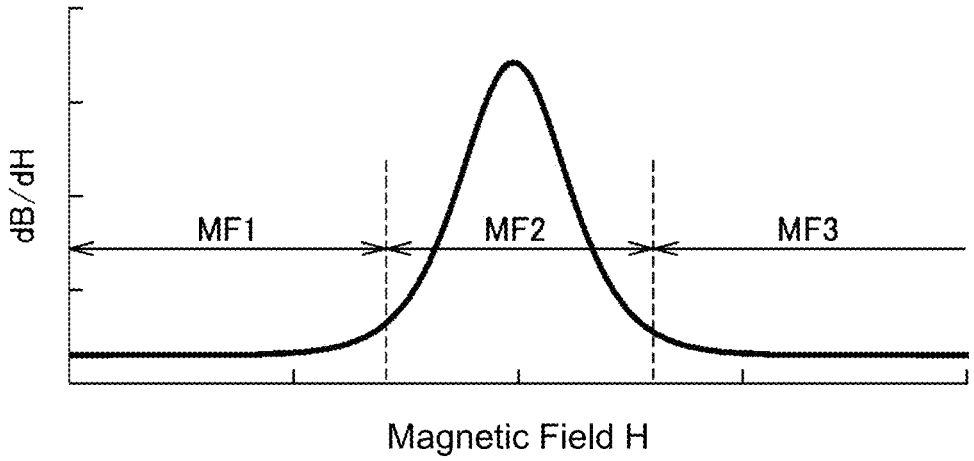
FIG. 4 is a graph illustrating the differential value of the characteristics illustrated in FIG. 3.
Figure 5:
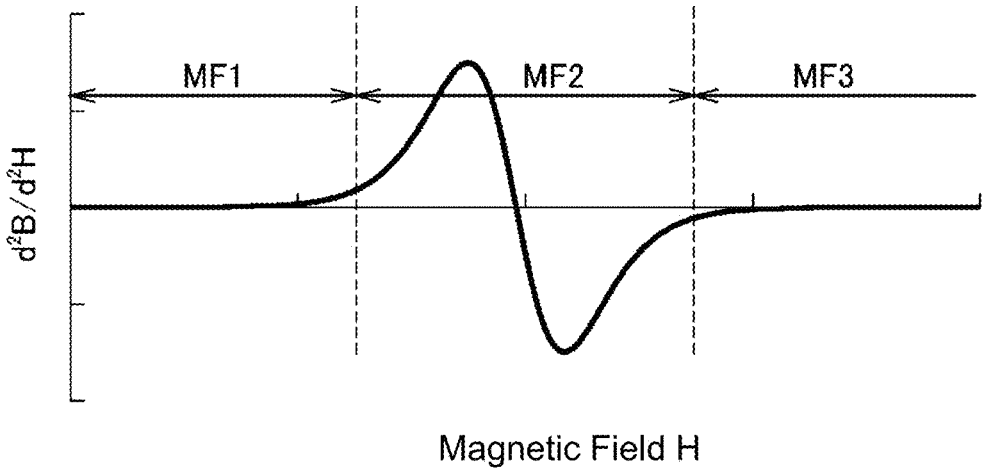
FIG. 5 is a graph illustrating the second order differential value of the characteristics illustrated in FIG. 3.

FIG. 4 is a graph illustrating the differential value of the characteristics illustrated in FIG. 3, and FIG. 5 is a graph illustrating the second order differential value of the characteristics illustrated in FIG. 3. The characteristics illustrated in FIG. 4 correspond to the differential permeability of the MnAl alloy according to the present embodiment.

As illustrated in FIG. 4, when the characteristics illustrated in FIG. 3 is subject to first order differentiation, the differential value becomes local maximum in the second magnetic field region MF2. In the first magnetic field region MF1 and third magnetic field region MF3, the differential value is still small. Then, as illustrated in FIG. 5, when the characteristics illustrated in FIG. 3 is subject to second order differentiation, the second order differential value is inverted from a positive value to a negative value in the second magnetic field region MF2. In the first magnetic field region MF1 and third magnetic field region MF3, the second order differential value is substantially zero. As described above, in the MnAl alloy according to the present embodiment, when the magnetic flux density B is subject to second order differentiation with respect to the magnetic field H, the second order differential value is inverted from a positive value to a negative value.

The MnAl alloy according to the present embodiment is obtained by electrolyzing molten salt in which a Mn compound and an Al compound are mixed and dissolved to deposit a MnAl alloy and then applying heat treatment to the MnAl alloy at a predetermined temperature.

Figure 6:
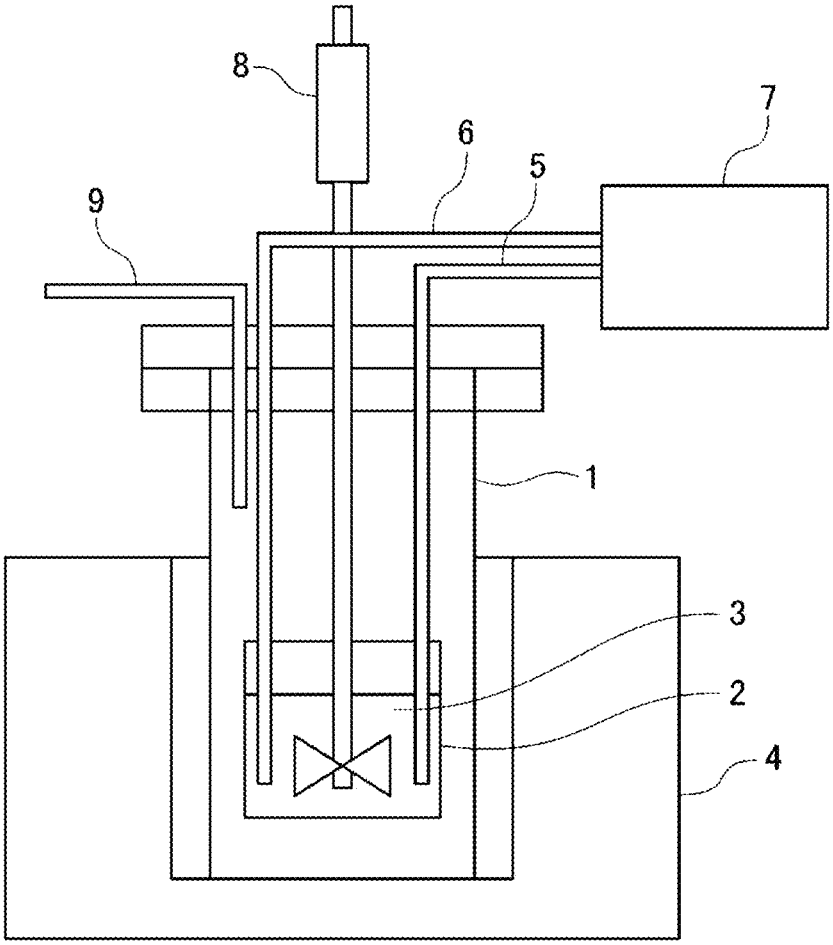
FIG. 6 is a schematic view of an electrodeposition apparatus for manufacturing the MnAl alloy.

FIG. 6 is a schematic view of an electrodeposition apparatus for manufacturing the MnAl alloy.

The electrodeposition apparatus illustrated in FIG. 6 has an alumina crucible 2 disposed inside a stainless sealed vessel 1. The alumina crucible 2 holds molten salt 3 therein, and the molten salt 3 inside the alumina crucible 2 is heated by an electric furnace 4 disposed outside the sealed vessel 1. The alumina crucible 2 is provided inside thereof with a cathode 5 and an anode 6 immersed in the molten salt 3, and current is supplied to the cathode 5 and anode 6 through a constant current power supply device 7. The cathode 5 is a plate-like member made of Cu, and the anode 6 is a plate-like member made of Al. The molten salt 3 inside the alumina crucible 2 can be stirred by a stirrer 8. The sealed vessel 1 is filled with inert gas such as $N_2$ supplied through a gas passage 9.

The molten salt 3 contains at least a Mn compound and an Al compound. As the Mn compound, $MnCl_2$ can be used. As the Al compound, $AlCl_3$, $AlF_3$, $AlBr_3$, or $AlNa_3F_6$ can be used. The Al compound may be composed of $AlCl_3$ alone, and a part of $AlCl_3$ may be substituted with $AlF_3$, $AlBr_3$, or $AlNa_3F_6$.

The molten salt 3 may contain another halide in addition to the above-described Mn compound and Al compound. As another halide, an alkali metal halide such as NaCl, LiCl, or KCl is preferably selected, and a rare earth halide such as $LaCl_3$, $DyCl_3$, $MgCl_2$, $CaCl_2$), $GaCl_3$, $InCl_3$, $GeCl_4$, $SnCl_4$, $NiCl_2$, $CoCl_2$, or $FeCl_2$, an alkaline earth halide, a typical element halide, and a transition metal halide may be added to the alkali metal halide.

The above Mn compound, Al compound, and another halide are charged in the alumina crucible 2 and heated and melted by the electric furnace 4, whereby the molten salt 3 can be obtained. The molten salt 3 is preferably stirred sufficiently by the stirrer 8 immediately after melting so as to make the composition distribution of the molten salt 3 uniform.

The electrolysis of the molten salt 3 is performed by making current flow between the cathode 5 and the anode 6 through the constant current power supply device 7. This allows the MnAl alloy to be deposited on the cathode 5. The heating temperature of the molten salt 3 during the electrolysis is preferably 150° C. or more and 450° or less. The electricity amount is preferably 15 mAh or more and 150 mAh or less per electrode area of 1 $cm^2$. During the electrolysis, the sealed vessel 1 is preferably filled with inert gas such as $N_2$.

Further, the electricity amount of the current made to flow between the cathode 5 and the anode 6 is set to 50 mAh or more per 1 mass % concentration of the Mn compound in the molten salt 3 and per 1 $cm^2$ electrode area, whereby a powdery MnAl alloy can be deposited on the cathode 5. That is, the higher the concentration of the Mn compound in the molten salt 3, the more rapidly the deposition is accelerated, and the more the electricity amount per unit electrode area, the more rapidly the deposition is accelerated, and the MnAl alloy to be deposited easily becomes powdery when the above value range (50 mAh or more) is satisfied. When the MnAl alloy deposited on the cathode is powdery, the deposition of the MnAl alloy is not stopped even when electrolysis is performed for a long time, thereby improving productivity of the MnAl alloy. Further, by compression molding the obtained powdery MnAl alloy, it is possible to obtain a desired product shape.

The initial concentration of the Mn compound in the molten salt 3 is preferably 0.2 mass % or more and, more preferably, 0.2 mass % or more and 3 mass % or less. Further, the Mn compound is preferably additionally thrown during electrolysis so as to maintain the concentration of the Mn compound in the molten salt 3. More specifically, powdery Mn compound or Mn compound in the form of pellets (obtained by molding powder) may additionally be thrown into the molten salt 3 continuously or periodically. When the Mn compound is additionally thrown during electrolysis of the molten salt 3, reduction in the concentration of the Mn compound associated with the progress of the electrolysis is suppressed, whereby the concentration of the Mn compound in the molten salt 3 can be maintained at a predetermined value or more. This makes it possible to suppress a variation in the composition of the MnAl alloy to be deposited.

The composition of the MnAl alloy deposited by electrolysis is: Mn is 45 at % or more and less than 55 at %. When Al is more than 45 at % and 55 at % or less, substantially the entire MnAl alloy is deposited as the τ-MnAl phase. When heat treatment is applied to the MnAl alloy of the τ-MnAl phase, the MnAl alloy is separated into the τ-MnAl phase and γ2-MnAl phase. This is probably because the movement of Al caused by heat treatment causes an Al-rich region where the Al concentration has increased to change to the γ2-MnAl phase and causes a region where the Al concentration has decreased to change to the τ-MnAl phase where Mn is rich. The ratio between the γ2-MnAl phase and the τ-MnAl phase changes according to heat treatment temperature.

Figure 7:
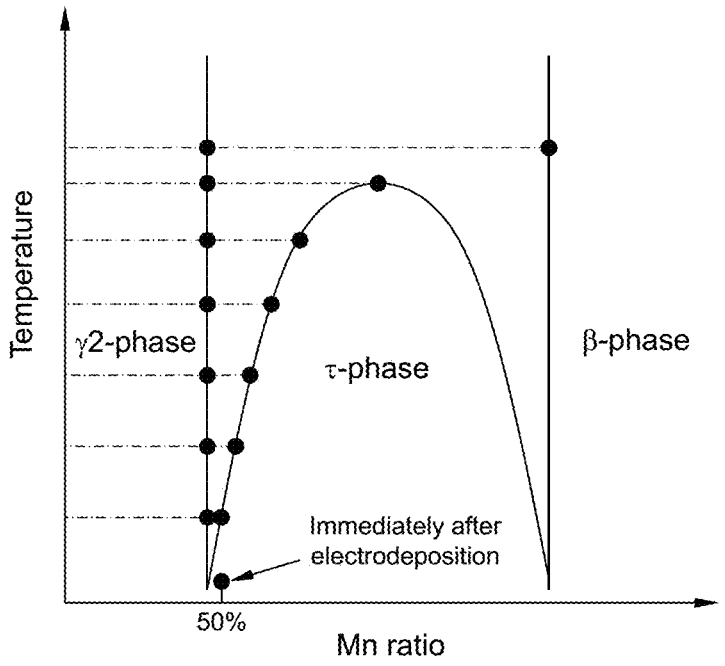
FIG. 7 is a schematic phase diagram of the MnAl alloy.

FIG. 7 is a schematic phase diagram of the MnAl alloy. In FIG. 7, the horizontal axis indicates Mn ratio, and vertical axis indicates temperature. Not all the results shown by the phase diagram of FIG. 7 is based on real measurement, and some are based on estimation.

As illustrated in FIG. 7, when a MnAl alloy in which Mn atomic ratio is 50% is produced by an electrodeposition method, substantially the entire MnAl alloy becomes the τ-phase. Then, when heat treatment is applied to the MnAl alloy, it is separated into the τ-MnAl phase and the γ2-MnAl phase due to movement of Al. Points denoted by a black circle in FIG. 7 represent phases existing at the respective temperatures. As can be understood from FIG. 7, the higher the temperature is, the higher the Mn ratio in the τ-MnAl phase becomes. On the other hand, even when the temperature is increased, the Mn ratio in the γ2-MnAl phase hardly changes. From this, it is thought that when the movement of Al occurs due to application of heat treatment, a region taking in the moving Al changes to the γ2-MnAl phase, while the Mn concentration in a region losing Al gradually increases.

However, when the heat treatment temperature exceeds a predetermined temperature, the τ-MnAl phase cannot exist, resulting in a state where the γ2-MnAl phase and the β-MnAl phase coexist. In this state, the τ-MnAl phase is absent, so that magnetism is lost.

It is estimated that by such a mechanism, application of heat treatment causes the ratio between the γ2-MnAl phase and the τ-MnAl phase as well as the Mn concentration in the τ-MnAl phase to change. Assuming that the area of the crystal grains containing the τ-MnAl phase is B, and the area of the crystal grains containing the γ2-MnAl phase is A, by controlling the heat treatment temperature such that the value of B/A falls within a range of 0.2 or more and 21.0 or less, metamagnetism is imparted to the MnAl alloy. Although the reason is unclear, it is thought that when the value of B/A falls within the above range, antiferromagnetism is imparted to the τ-MnAl phase, whereby AFM-FM transition type metamagnetism is exhibited.

The MnAl alloy according to the present embodiment can be applied to various electronic components. For example, when the MnAl alloy according to the present embodiment is used as a magnetic core, application to a reactor, an inductor, a current limiter, an electromagnetic actuator, a motor, or the like is possible. Further, when the MnAl alloy according to the present embodiment is used as a magnetic refrigeration substance, application to a magnetic refrigerator is possible.

It is apparent that the present invention is not limited to the above embodiments, but may be modified and changed without departing from the scope and spirit of the invention.

For example, in the above embodiment, the MnAl alloy is deposited by the electrodeposition method, and then heat treatment is applied to the deposited MnAl alloy, whereby the value of B/A is controlled; however, the manufacturing method for the MnAl alloy is not limited to this. Alternatively, the molten metal of the MnAl alloy is obtained by melting, and then the obtained molten metal is rapidly cooled by a liquid quenching method or an atomizing method to obtain a MnAl alloy in an amorphous state, followed by heat treatment. Even in this method, the value of B/A can be controlled. Further alternatively, a MnAl alloy in an amorphous state is obtained by a thin film method such as a sputtering method or a vapor deposition method, followed by heat treatment. Even in this method, the value of B/A can be controlled.

EXAMPLES

<Production of MnAl Alloy by Electrolysis Method>

First, an electrodeposition apparatus having the structure illustrated in FIG. 6 was prepared. As the cathode 5, a Cu plate having a thickness of 3 mm cut out so as to set the immersion area into the molten salt 3 to a size of 5 cm×8 cm was used. As the anode 6, an Al plate having a thickness of 3 mm cut out so as to set the immersion area into the molten salt 3 to a size of 5 cm×8 cm was used.

Then, 50 mol % anhydrous $AlCl_3$ which is an Al compound, 50 mol % NaCl which is another halide, and 1 mass % $MnCl_2$ dehydrated in advance as the Mn compound are weighed and thrown into the alumina crucible 2 such that the total weight thereof was 1200 g. Thus, the weight of $MnCl_2$ was g. The dehydration was performed by heating $MnCl_2$ hydrate at about 400° C. for four hours or longer in an inert gas atmosphere such as $N_2$.

The alumina crucible 2 into which the materials had been thrown was moved inside the sealed vessel 1, and the materials were heated to 350° C. by the electric furnace 4, whereby the molten salt 3 was obtained. Then, rotary vanes of the stirrer 8 were sunk into the molten salt 3, and stirring was performed at a rotation speed of 300 rpm for 0.5 hours. Thereafter, in a state where a temperature of the molten salt is kept at 200° C., 250° C., or 300° C., a constant current of 60 mA/cm$^2$ (2.4 A) per unit electrode area was conducted between the cathode 5 and the anode 6 for four hours, and the current conduction and heating were stopped. Then, the electrode was removed before the molten salt 3 would become cool and solid, and the cathode 5 is subjected to ultrasonic washing using acetone. A film-like electrodeposit and powdery electrodeposits (MnAl alloy) were deposited on the surface of the cathode 5. The film-like electrodeposit was collected by dissolving and removing Cu constituting the cathode 5 and pulverized with a mortar into powder. Some of the powdery electrodeposits were left on the cathode 5, but the rest were deposited on the bottom portion of the alumina crucible 2. Therefore, the powdery electrodeposits sunk into the molten salt 3 were filtered and collected. At the same time, the molten salt was subjected to decantation, and the mixture of the powdery electrodeposits left on the bottom portion and the molten salt was cooled and solidified, followed by washing using acetone and filtering/collection. The powdery electrodeposits obtained by both the above collection methods were mixed with a powdery sample obtained by pulverizing the film-like electrodeposit.

<Heat Treatment of MnAl Alloy>

Powder samples obtained at electrodeposition temperatures of 300° C., 250° C., and 200° C. were used as Comparative Examples 1 to 3, respectively.

The powder sample of Comparative Example 1 was subjected to heat treatment at 400° C. to 700° C. for 16 hours in an Ar atmosphere. A sample obtained at 400° C. was used as Example 1, a sample obtained at 425° C. was used as Example 2, a sample obtained at 450° C. was used as Example 3, a sample obtained at 475° C. was used as Example 4, a sample obtained at 500° C. was used as Example 5, a sample obtained at 550° C. was used as Example 6, a sample obtained at 562° C. was used as Example 7, a sample obtained at 600° C. was used as Comparative Example 4, a sample obtained at 650° C. was used as Comparative Example 5, and a sample obtained at 700° C. was used as Comparative Example 6. Further, samples obtained by applying heat treatment at 550° C. for 16 hours in an Ar atmosphere were used as Examples 8 and 9, respectively.

<Production of MnAl Alloy by Melting Method>

Mn metal of purity 99.9 mass % or more and Al metal of purity 99.9 mass % or more were weighed in a ratio of 55 at %: 45 at % and subjected to arc melting in an Ar atmosphere to produce a raw material ingot.

The obtained raw material ingot was subjected to heat treatment at 1150° C. in an Ar atmosphere for two hours, followed by in-water quenching. Thereafter, the resultant ingot was subjected to heat treatment at 600° C. in an Ar atmosphere for one hour, followed by slow cooling. Thereafter, the resultant ingot was pulverized in a stamp mill to obtain 100 μm or less powder. The obtained sample was used as Comparative Example 7.

<Evaluation of Magnetic Characteristics>

Magnetic characteristics were measured for samples of Examples 1 to 9 and Comparative Examples 1 to 7 in a magnetic field range of 0 kOe to 100 kOe at room temperature using a pulsed high field magnetometer (Toei Industry Co., Ltd.), and the presence/absence of metamagnetism was determined based on obtained magnetization curves.

Further, mass magnetization at 100 kOe was set as maximum mass magnetization σmax, magnetization around 0 kOe was set as residual mass magnetization σr, and the ratio σr/σmax was set as a squareness ratio. A sample having a squareness ratio of 0.1 or more was determined to have residual magnetization, and a sample having a squareness ratio of less than 0.1 was determined not to have residual magnetization.

<Evaluation of Area Ratio of τ-Phase/γ2-Phase>

1. Embedding of Measurement Powder in Resin

Each of the samples of Examples 1 to 9 and Comparative Examples 1 to 7 and thermosetting resin (G2 resin) were mixed well in an approximately equivalent volume ratio, and the mixture was applied on a sample table (pin stub) for FIB (Focused Ion Beam), followed by vacuum defoaming, and then heating was applied to the resultant mixture using a hot plate at 120° C. for one hour for curing.

2. Surface Polishing

The surface of each of the samples produced in the above 1. was dry polished using a sandpaper. Specifically, rough polishing was first performed using a rough sandpaper (#600), followed by polishing using a medium sandpaper (#1200) and final polishing using a fine sandpaper (#3000), whereby the polishing surface was made into a mirror surface.

3. FIB Processing

Each of the samples subjected to the mirror finishing in the above 2. was processed into a flake using an FIB apparatus.

4. STEM-EDS Measurement (Scanning Transmission Electron Microscopy-Energy Dispersive Spectroscopy).

An aberration correction TEM was used to perform STEM-EDS measurement for the cross-section of the flake obtained in the above 3. at an acceleration voltage of 300 kV. Specifically, 100 measurements were performed over 600 seconds at a resolution of 512×512 pixels with respect to a visual field of 10 μm×10 μm, and an EDS map was obtained with image drift correction ON. As a result, an Al map representing the distribution of Al-rich MnAl crystal grains and a Mn map representing the distribution of Mn-rich MnAl crystal grains were generated.

5. Image Synthesis

Figure 8:
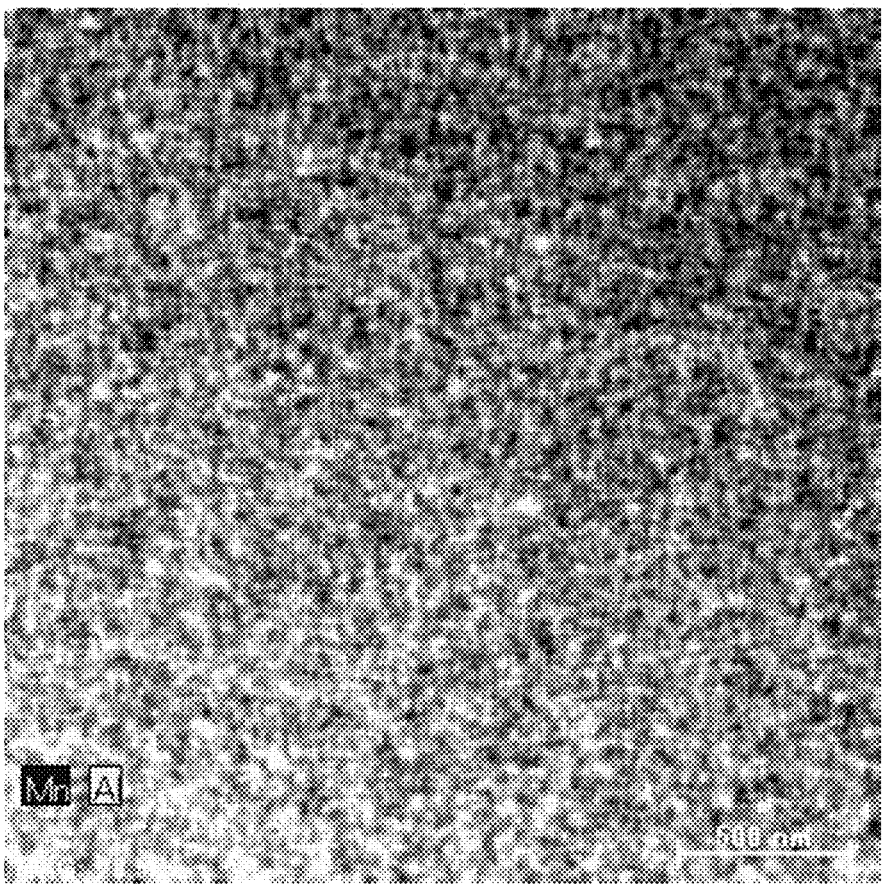
FIG. 8 is a synthesized map of Comparative Example 1.
Figure 9:
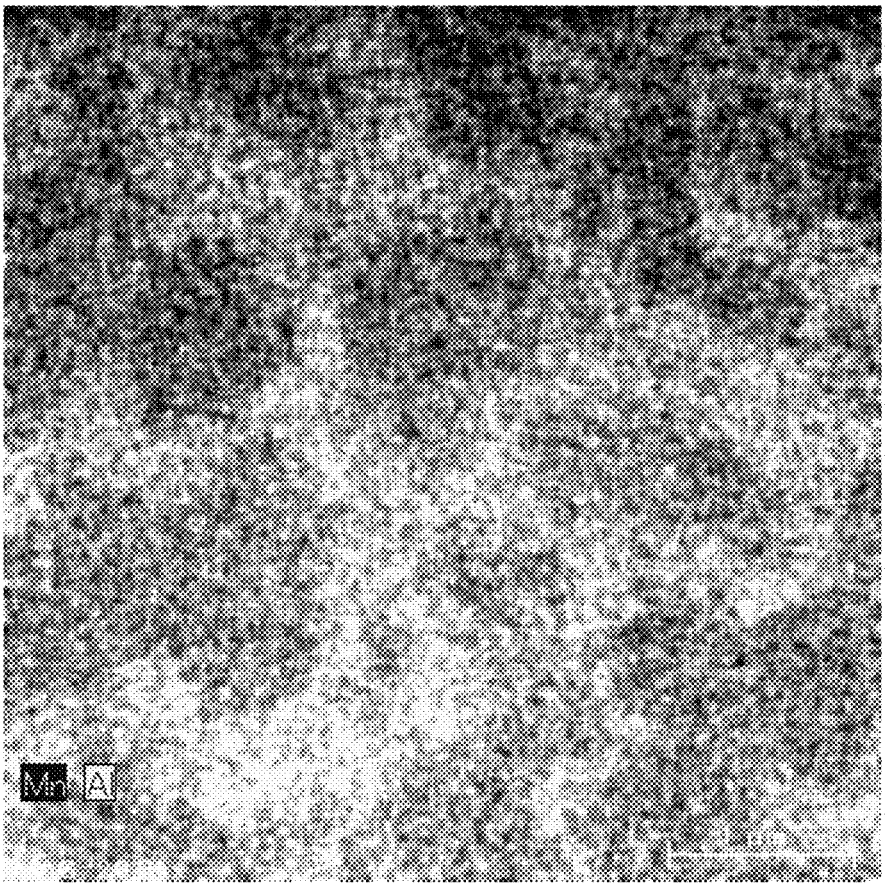
FIG. 9 is a synthesized map of Example 4.

The Al map and Mn map obtained in the above 4. were synthesized on EDS measurement software to generate a synthesized map. FIG. 8 is a synthesized map of Comparative Example 1, and FIG. 9 is a synthesized map of Example 7. As can be seen from FIG. 8, in the sample of Comparative Example 1 not having been subjected to heat treatment, Mn and Al are dispersed almost uniformly. On the other hand, in the sample of Example 7 having been subjected to heat treatment (562° C., 16 hours), the Mn-rich region and the Al-rich region exist separately.

6. Evaluation of Crystal Structure

TEM (Transmission Electron Microscopy) analysis was performed for the Al-rich MnAl crystal grains and Mn-rich MnAl crystal grains for confirmation of an electron beam diffraction image, to thereby make phase identification. As a result, the Al-rich MnAl crystal grains were identified as the γ2-MnAl phase, and the Mn-rich MnAl crystal grains were identified as the τ-MnAl phase. In the samples of Comparative examples 5 and 6, the β-MnAl phase was also confirmed.

7. Evaluation of Area Ratio

The synthesis map obtained in the above 5. was analyzed by image analysis/image measurement software to measure an area (A) occupied by the Al-rich MnAl crystal grains and an area (B) occupied by the Mn-rich MnAl crystal grains. Then, the ratio (A/M) of the area A relative to the area (M) of the entire measurement area and the ratio (B/M) of the area B were calculated. After that, $$(B/M)/(A/M)=B/A$$

was calculated.

<Evaluation of Average Crystal Grain Diameter>

The samples having been subjected to the above 1. (embedding of measurement powder in resin), 2. (surface polishing), and 3. (FIB processing) were observed using a STEM (Scanning Transmission Electron Microscopy), and a BF (Bright Field) image was photographed for each sample. The measurement range was 10 μm×10 μm. Then, image analysis/image measurement software was used to measure a crystal grain diameter D of the Mn-rich MnAl crystal grains (τ-MnAl phase). The number of samples was 100, and an average crystal grain diameter of 100 samples was calculated. The crystal grain diameter D was a circle equivalent diameter, so that the following relationship is satisfied between the crystal grain diameter D and an area S:

$$D=\sqrt{(4S/\pi)}.$$

<Evaluation of Magnetic Structure>

The powder samples were measured in a range of 1 Å to 40 Å in terms of lattice spacing d by a time-of-flight neutron diffraction method, and when a magnetic structure having a longer period than the τ-MnAl crystal structure was observed, it was determined that crystal grains having an antiferromagnetic structure was present. In a case where not all the values of Miller indices (h, k, l) of the diffraction peak attributable to the magnetic structure assume an integer when indexing is performed based on the crystal structure of the τ-MnAl, the presence of the long-period magnetic structure can be determined. The peak attributable to the magnetic structure is obtained by subtracting the peak attributable to the crystal structure obtained by the X-ray diffraction from the diffraction peak obtained by the neutron diffraction. For example, in Miller indices (1, 0, ½) indicating that a double-period magnetic structure is present in the c-axis direction of the τ-MnAl, the miller index l is ½, which is a rational number, so that it can be understood that a double-period magnetic structure is present in the c-axis direction.

<Evaluation Results>

Evaluation results are shown in FIG. 10.

As shown in FIG. 10, the samples of Examples 1 to 9 in which the MnAl alloys obtained by the molten salt electrolysis method (electrodeposition method) have been subjected to heat treatment at 400° C. to 562° C. have area ratios (B/A) of 0.2 to 21.0 and all exhibit metamagnetism. Particularly, the samples of Examples 4 to 9 having area ratios (B/A) of 0.2 or more and less than 4.0 do not have residual magnetization and exhibit almost clear metamagnetism. Among them, the samples of Examples 4 to 7 having area ratios (B/A) of 1.0 or more and less than 4.0 have a large saturation magnetization value. Further, in the samples of Examples 1 to 9, the average crystal grain diameter of the Mn-rich MnAl crystal grains (τ-MnAl phase) is 0.24 to 0.91.

On the other hand, the samples of Comparative Examples 1 to 7 have area ratios of less than 0.2 or more than 21.0 and all do not exhibit metamagnetism. Particularly, the samples of Comparative Examples 1 to 3 and 7 exhibit ferromagnetism and have residual magnetization. On the other hand, the samples of Comparative Examples 4 to 6 exhibit non-magnetism.

Further, in all of the samples of Examples 1 to 9, the τ-MnAl phase and the γ2-MnAl phase coexist, and the τ-MnAl phase has an antiferromagnetic structure in a non-magnetic field state. Further, in all of the samples of Examples 1 to 9, the Mn ratio in the MnAl alloy is 45 at % or more and 50 at % or less, and the Mn ratio in the τ-MnAl phase is 48 at % or more and 53.5 at % or less.

Then, magnetic characteristics were evaluated in a temperature range of −100° C. to 200° C. for the samples of Example 5 and Comparative Examples 1 and 7. The results are shown in Table 1.

TABLE 1

| | Measurement Temperature (° C.) | Metamagnetism |
|---|---|---|
| Comparative Example 1 | −100 | NO |
| | −50 | NO |
| | 25 | NO |
| | 50 | NO |
| | 100 | NO |
| | 150 | NO |
| | 200 | NO |
| Example 5 | −100 | YES |
| | −50 | YES |
| | 25 | YES |
| | 50 | YES |
| | 100 | YES |
| | 150 | YES |
| | 200 | YES |
| Comparative Example 7 | −100 | NO |
| | −50 | NO |
| | 25 | NO |
| | 50 | NO |
| | 100 | NO |
| | 150 | NO |
| | 200 | NO |

As shown in Table 1, the sample of Example 5 exhibits metamagnetism over a wide temperature range of −100° C. to 200° C.

REFERENCE SIGNS LIST

1: Sealed Vessel
2: Alumina crucible
3: Molten salt
4: Electric furnace
5: Cathode
6: Anode
7: Constant current power supply device

8: Stirrer

9: Gas passage

What is claimed is:

1. An electrodeposited and heat-treated MnAl alloy exhibiting metamagnetism comprising crystal grains containing a τ-MnAl phase and crystal grains containing a γ2-MnAl phase, a ratio between the crystal grains containing the τ-MnAl phase and the crystal grains containing the γ2-MnAl phase being dependent upon a temperature of a heat treatment carried out after the electrodeposition of the MnAl alloy.

2. The MnAl alloy as claimed in claim 1, wherein a value of B/A is 0.2 or more and 21.0 or less, where an area of the crystal grains containing the τ-MnAl phase in a predetermined cross section of the MnAl alloy is B, and an area of the crystal grains containing the γ2-MnAl phase in the predetermined cross section of the MnAl alloy is A.

3. The MnAl alloy as claimed in claim 2, wherein the value of B/A is 1.0 or more and less than 4.0.

4. The MnAl alloy as claimed in claim 1, wherein an average crystal grain diameter of the crystal grains containing the τ-MnAl phase is 0.1 μm or more and 1.0 μm or less.

5. The MnAl alloy as claimed in claim 1, wherein when a composition of the MnAl alloy is expressed by $Mn_b Al_{100-b}$, $45 \leq b < 55$ is satisfied.

6. The MnAl alloy as claimed in claim 5, wherein $45 \leq b < 52$ is satisfied.

7. The MnAl alloy as claimed in claim 1, wherein a magnetic structure of the τ-MnAl phase has an antiferromagnetic structure in a non-magnetic field state.

8. The MnAl alloy as claimed in claim 7, wherein when a composition of the τ-MnAl phase is expressed by $Mn_a Al_{100-a}$, $48 \leq a < 55$ is satisfied.

9. A method of producing a MnAl alloy, comprising:

electrodepositing an MnAl alloy of a τ-MnAl phase;

heat-treating the electrodeposited MnAl alloy of the τ-MnAl phase to a predetermined temperature that separates the MnAl alloy into a τ-MnAl phase and a γ2-MnAl phase, such that the electrodeposited and heat-treated MnAl alloy comprises crystal grains containing a τ-MnAl phase and crystal grains containing a γ2-MnAl phase, a ratio between the crystal grains containing the τ-MnAl phase and the crystal grains containing the γ2-MnAl phase being dependent upon the predetermined temperature of the heat treatment and such that the electrodeposited and heat treated MnAl alloy exhibits metamagnetism.

10. The method as claimed in claim 9, further comprising controlling the heat-treatment of the electrodeposited MnAl to control a value of a B/A ratio to be 0.2 or more and 21.0 or less, where an area of the crystal grains containing the τ-MnAl phase in a predetermined cross section of the MnAl alloy is B, and an area of the crystal grains containing the γ2-MnAl phase in the predetermined cross section of the MnAl alloy is A.

11. The method as claimed in claim 10, wherein the value of B/A is 1.0 or more and less than 4.0.

12. The method as claimed in claim 9 wherein, during heat treating, an average crystal grain diameter of the crystal grains containing the τ-MnAl phase is 0.1 μm or more and 1.0 μm or less.

13. The method as claimed in claim 9, further comprising, when a composition of the MnAl alloy is expressed by $Mn_b Al_{100-b}$, satisfying $45 \leq b < 55$.

14. The method as claimed in claim 13, further comprising satisfying $45 \leq b < 52$.

15. The method as claimed in claim 9, wherein a magnetic structure of the τ-MnAl phase has an antiferromagnetic structure in a non-magnetic field state.

16. The method as claimed in claim 15, further comprising, when a composition of the MnAl alloy is expressed by $Mn_a Al_{100-a}$, satisfying $48 \leq a < 55$.

* * * * *